United States Patent [19]

Morin

[11] Patent Number: 4,579,336

[45] Date of Patent: Apr. 1, 1986

[54] SPHERICAL ROLLING CAGE FOR RECREATION AND ENTERTAINMENT

[76] Inventor: Dennis Morin, 41 Bobby La., Manchester, Conn. 06040

[21] Appl. No.: 603,154

[22] Filed: Apr. 23, 1984

[51] Int. Cl.[4] ..... A63G 25/00

[52] U.S. Cl. ..... 272/115; 280/206; 441/78; D21/71

[58] Field of Search ..... 272/115, 1 B; 280/206, 280/207, 208, 78; 440/100; 441/78, 87; 128/25 R; D21/71

[56] References Cited

U.S. PATENT DOCUMENTS

| | | | |
|---|---|---|---|
| 601,107 | 3/1898 | Simpier | 280/208 |
| 2,535,763 | 12/1950 | Tucker | 188/72.4 |
| 3,156,486 | 11/1964 | Fenwick | 272/115 |
| 3,183,020 | 5/1965 | Hawver | 188/71.2 |
| 3,290,057 | 12/1966 | Turner | 280/206 |
| 3,334,915 | 8/1967 | Sulyma et al. | D21/71 |
| 3,718,342 | 2/1973 | Freed | 272/115 |
| 4,458,895 | 7/1984 | Turcotte | 272/115 |
| 4,505,346 | 3/1985 | Mueller | 280/206 |

*Primary Examiner*—Richard J. Apley
*Assistant Examiner*—S. R. Crow
*Attorney, Agent, or Firm*—Fishman & Dionne

[57] ABSTRACT

A spherical recreational rolling cage comprised of at least three mutually orthogonal hoops is presented. The spherical cage includes an axle attached between two of the hoops and a rotatable seating assembly connected to the axle via a bearing whereby the seating assembly swivels freely relative to the spherical cage. Novel braking means, preferably of the disk type, and steering means are also incorporated into the rolling cage of the present invention.

13 Claims, 4 Drawing Figures

SPHERICAL ROLLING CAGE FOR RECREATION AND ENTERTAINMENT

BACKGROUND OF THE INVENTION

This invention relates to an amusement vehicle of the rolling or tumbling type. More particularly, this invention relates to a new and improved spherical recreational rolling device comprised of at least three mutually orthogonal hoops. A novel seating assembly is rotatably connected to a central axle via a bearing sleeve so that the seating assembly swivels freely relative to the rolling cage. The seating assembly also includes novel braking and steering mechanisms.

In recent years, ski resort operators have been looking for ways of utilizing their snow barren ski slopes during the "off-season", i.e., summer and fall. For this reason, amusement devices such as the Alpine Slide have gained increasing popularity. Obviously, still other means of using a ski slope for different types of recreational activity would be highly desirable in terms of optimizing income to the ski resort managers as well as providing a new means of entertainment and sport for the general public. One device fitting the above description is a spherical tumbling or rolling cage.

Spherical rolling devices for amusement and recreation are known. For example, U.S. Pat. No. 3,334,915 to Sulyma et al discloses a rollable cage consisting of a plurality of pairs of connected hoops, arranged transverse to each other, to form a spherical cage and having a means for securely seating a passenger therein. Similarly, U.S. Pat. No. 3,156,486 to Fenwick has a generally spherical shape comprised of four identical hoops having two flat surfaces 180 degrees apart. As in Sulyma et al, a seat means for the occupant is provided within the cage.

Unfortunately, both of the above-described prior art spherical rolling devices suffer from a number of problems and deficiencies. Chief among those problems is a lack of an adequate braking and/or steering mechanism. In both rolling devices, the occupant merely straps in and then tumbles head over heel with no control over speed or direction. The absence of these controls is not only dangerous, but also diminishes the degree of skills which make any sport worthwhile. Moreover, because the occupant tumbles round and round, disorientation and nausea will often be uncomfortable side effects to any ride.

SUMMARY OF THE INVENTION

The above discussed and other problems of the prior art are overcome or alleviated by the spherical rolling cage of the present invention. In accordance with the present invention, a novel braking and steering mechanism is provided to a recreational vehicle comprised of at least three mutually orthogonal hoops. The spherical cage includes an axle attached between two of the hoops and a rotatable seating assembly connected to the axle via a bearing whereby the seating assembly swivels freely relative to the spherical cage. Preferably, the novel brake and steering means are integral with the rotatable seating assembly.

The spherical cage of the present invention combines a relatively simple and cost effective design with exciting and novel features heretofore not found in the prior art. Thus, the operator will not be forced to tumble head over heel thereby alleviating the adverse results therefrom. Also, the steering and braking mechanism greatly adds to the vehicle safety while permitting the honing of operator skills. Finally, the present invention provides a new and profitable use for ski slopes during the off-season (it should be appreciated that the present invention may be also used on snow as well).

The above-discussed and other advantages of the present invention will be apparent to and understood by those skilled in the art from the following detailed description and drawings:

BRIEF DESCRIPTION OF THE DRAWINGS

Referring now to the drawings, wherein like elements are numbered alike in the several Figures.

DESCRIPTION OF THE PREFERRED EMBODIMENT

Figure 1:
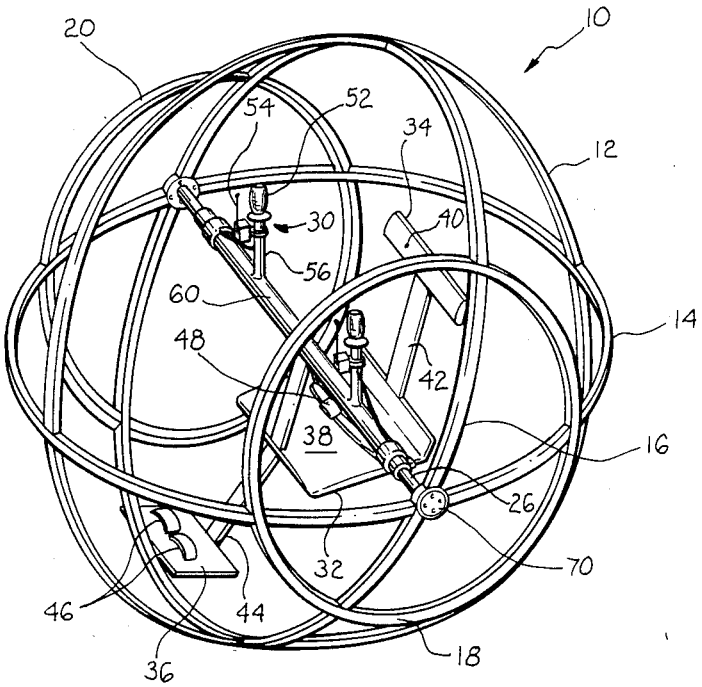
FIG. 1 is a perspective view of the spherical rolling cage in accordance with the present invention.
Figure 3:
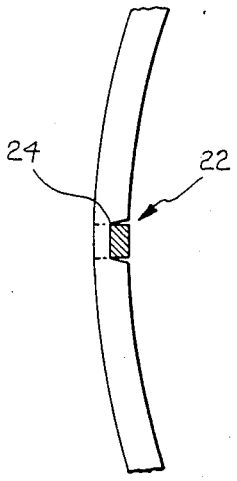
FIG. 3 is an enlarged elevation view, partly in cross-section, of a joint assembly of FIG. 1.

Referring first to FIG. 1, a spherical rolling cage in accordance with the present invention is shown generally at 10. Spherical cage 10 is essentially comprised of three mutually orthogonal hoops 12, 14 and 16 which form the basic cage configuration. Preferably, at least two smaller hoops 18 and 20 are added for strength and stability. All of the hoops are preferably constructed of a suitable lightweight, high strength tubing material. It is important that the outside surface of the case be smooth and free from protrusions in order to provide a smooth ride during operation. Accordingly, with reference to FIG. 3, each hoop intersection or hoop joint 22 should be flattened such that the hoops evenly mesh and interlock. It should be understood that the hoops may be interconnected by any suitable means such as welding 24.

Figure 2:
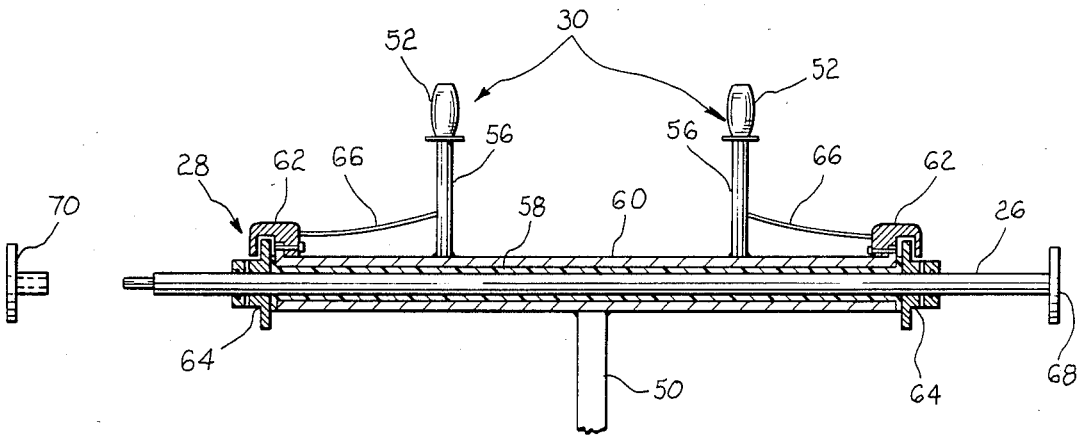
FIG. 2 is an elevation view, partly in cross-section, of the steering and braking mechanism for the spherical rolling cage of FIG. 1 in accordance with the present invention.

Referring jointly now to FIGS. 1 and 2, the interior of cage 10 is comprised of a seat assembly rotatably attached to an axle 26. Axle 26 includes a novel brake means 28 and a pair of handlebars 30. The seat assembly is constructed of a preferably lightweight, high strength material having a seat portion 32, shoulder rest 34 and a foot rest 36. A seat pad 38 and shoulder pad 40 are preferably added to increase the operator's comfort. Seat 32 and shoulder rest 34 are connected by extension member 42 while seat 32 and foot rest 36 are connected by extension member 44. Foot rest 36 should be provided with straps 46 to hold applicant's feet while seat portion 32 should preferably have a seat belt 48 in order to protect the operator during cage 10 operation.

The seat assembly is rotatably connected to axle 26 via rigid support 50. Also connected to axle 26 are the two handlebars 30 comprised of grips 52 associated with brake handles 54 (FIG. 1), both of which are mounted on necks 56. As mentioned, the seat assembly freely swivels or rotates on the axle 26 via a suitable bearing 58 such as a teflon sleeve bearing or its equivalent. Sleeve bearing 58 is sandwiched between axle 26 and bearing housing 60. Note that rigid support 50 is welded or otherwise mounted to housing 60. The axle 26 surrounded by bearing 58 and outer housing 60 permits the spherical cage 10 to freely rotate about a relatively stationary seating assembly.

Attached between housing 60 and axle 26 are a pair of disk brakes 28. Brakes 28 are comprised of a disk brake caliper 62 attached to housing 60 and spaced from a disk 64, the disk 64 being keyed to axle 26. The brakes 28 are actuated by a pair of brake handles 54 (FIG. 1) adjacent the handlegrips 52. Brake handles 54 connect to disk brake calipers 62 via hydraulic brake lines 66. It will be appreciated that the braking system shown herein is typical of those found on motorcycles and is intended to provide a maximum amount of braking force during operation.

Figure 4:
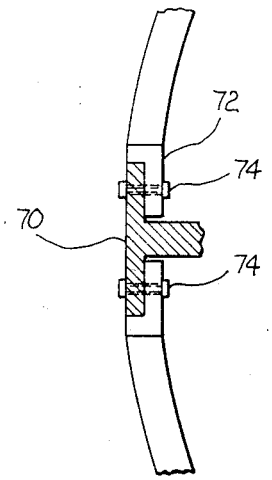
FIG. 4 is an enlarged elevation view, partly in cross-section, of an axle end plate/cap attachment to the rolling cage of FIG. 1.

In the particular embodiment of the present invention shown in FIGS. 1, 2 and 4, axle 26 is provided with an integral end plate 68 at one end, while the opposite end has a detachable end cap assembly 70. This structure will facilitate assembly during the loading of the axle 26 and seating assembly into the cage 10. A mounting flange 72 is provided at either end of the cage 10 to accept and retain the end cap assembly 70 and end plate 68. End cap 70 and plate 68 may be fixed to flange 72 by bolts 74 or any other suitable means, i.e., welding.

During typical operation of the present invention, the operator climbs inside the spherical rolling cage 10 and straps himself into the seat. For safety reasons, a helmet should be worn and the feet should be securely strapped to the foot rest portion of the seat. For further safety, a shoulder restraint may be desirable and even necessary for aggressive operation at high speed. If the cage 10 is on an incline, a method of keeping it from rolling while the operator is entering and strapping himself in would be required such as a chock, tether or the like.

To begin operation, the operator allows the cage 10 to roll down the incline while sitting in a normal semi-reclining position without applying any braking force. The operator can slow the speed of the rolling cage by applying both brakes evenly, even to the point of stopping it completely. During the high speed downhill operation, "locking" the brakes could cause the operator to travel 360° over the axle assembly, adding to the excitement of operation. The operator can steer the device by leaning to one side and thus altering its direction. The application of only one brake can enhance the ability to steer the device. It is also possible for the operator to turn the device in such a fashion such that it will roll backwards, i.e., 180° from the typical mode whereby the operator faces the direction of motion.

The spherical rolling cage of the present invention may be used on any suitable slope, such as a ski slope, a park with a hill, a large sand dune or a closed-off track or city street, and provide an exciting ride for the operator. In addition, a suitable amusement ride could be constructed by providing an inclined track upon which the device could travel. Note that operation in sand or snow can be facilitated by using thick cage construction or by mounting pads on the cage itself.

It will be understood to those skilled in the art that a simple towing device consisting of two clamp-on brackets that clamp over the mounting flange 72 on the left and right sides of the axle assembly can be used to tow the device uphill, possibly using existing ski tow facilities. The clamp-on brackets would have a swivel eye hook to which the tow line would be clipped.

The spherical rolling cage of the present invention provides many features and improvements not found in the prior art. Thus, the cage 10 has a simple outer construction consisting essentially of only three orthogonal hoops 12, 14 and 16. Also, unlike the prior art, the operator is not necessarily tumbled head over heel, but remains stationary relative to the rolling cage. This notable feature is effected by the novel axle and seat assembly.

Yet another novel feature of the present invention is the braking and steering mechanism associated with the axle and seat assembly. The brakes provide greater safety, control and overall excitement to the occupant relative to prior art devices such as found in U.S. Pat. Nos. 3,156,486 and 3,334,915.

It should be understood to those skilled in the art that many variations may be made to such features as axle configuration, materials and methods of assembling the cage, seat shape and configuration, handlebar location, braking system, etc. without departing from the scope of this invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A recreational device for rolling along a surface comprising:

at least three first hoops, said hoops being mutually orthogonal, said hoops defining a spherical cage, said spherical cage being adapted to freely roll in any direction along the perimeters of said hoops such that any portion of said cage can engage said surface;

axle means attached between two of said hoops;

rotatable seating assembly means connected to said axle means via bearing means wherein said seating assembly means rotates freely relative to said spherical cage; and means for braking, said braking means being located between said axle means and said rotatable seating assembly means, said braking means frictionally acting on said bearing means.

2. The device of claim 1 including:

steering means, said steering means being attached to said rotatable seating assembly.

3. The device of claim 1 including:

at least one second support hoop connected to at least two of said first hoops.

4. The device of claim 1 wherein said rotatable seating assembly includes:

a seat portion suspended from said bearing means;

a foot rest extending from said seat portion; and a shoulder rest extending from said seat portion.

5. The device of claim 1 or 4 wherein said bearing means includes:

bearing sleeve means in contact with and surrounding a portion of said axle means; and outer bearing housing means in contact with and surrounding said bearing sleeve means.

6. The device of claim 4 wherein said rotatable seating assembly includes safety straps.

7. The device of claim 5 wherein said braking means comprises:

disk brake caliper means being attached to said bearing housing means;

disk means, said disk means being attached to said axle means; and means for actuating said brake caliper means wherein said caliper means is urged into contact with said disk means.

8. The device of claim 7 wherein said actuating means includes:

brake handle means; and hydraulic brake line means connecting said brake handle means to said brake caliper means.

9. The device of claim 8 including:

steering means wherein said steering means is attached to said rotatable seating assembly.

10. The device of claim 9 wherein said steering means includes a pair of handlebars extending from said bearing housing.

11. The device of claim 10 wherein:

said brake handle means are attached to said handlebars.

12. The device of claim 2 wherein:

said steering means includes a pair of handlebars extending from said bearing means.

13. The device of claim 5 wherein said bearing means is comprised of TEFLON.

* * * * *